US008764487B2

(12) United States Patent
Ballard

(10) Patent No.: US 8,764,487 B2
(45) Date of Patent: Jul. 1, 2014

(54) CONNECTOR ASSEMBLY, DEVICE, AND KIT

(75) Inventor: Kenneth Ballard, King, NC (US)

(73) Assignee: Precision Concepts Group LLC, Winston-Salem, NC (US)

( * ) Notice: Subject to any disclaimer, the term of this patent is extended or adjusted under 35 U.S.C. 154(b) by 67 days.

(21) Appl. No.: 13/464,475

(22) Filed: May 4, 2012

(65) Prior Publication Data

US 2012/0282813 A1 Nov. 8, 2012

Related U.S. Application Data

(60) Provisional application No. 61/482,962, filed on May 5, 2011.

(51) Int. Cl.
*H01R 13/648* (2006.01)

(52) U.S. Cl.
USPC ..... 439/607.47; 439/752; 439/701

(58) Field of Classification Search
USPC ..... 439/607.47, 607.44, 752, 701, 274, 275
See application file for complete search history.

(56) References Cited

U.S. PATENT DOCUMENTS

| | | | | |
|---|---|---|---|---|
| 3,659,251 | A * | 4/1972 | Fish | 439/607.47 |
| 4,508,414 | A * | 4/1985 | Kusui et al. | 439/607.47 |
| 5,020,933 | A | 6/1991 | Salvestro et al. | |
| 5,738,546 | A | 4/1998 | Burroughs et al. | |
| 5,755,597 | A * | 5/1998 | Panis et al. | 439/607.47 |
| 5,848,914 | A * | 12/1998 | Lang et al. | 439/607.47 |
| 6,846,996 | B2 | 1/2005 | Kent et al. | |
| 6,872,092 | B2 * | 3/2005 | Oka | 439/587 |
| 7,075,023 | B2 | 7/2006 | Kent et al. | |
| 7,226,316 | B2 * | 6/2007 | Wu | 439/607.44 |
| 7,256,362 | B2 | 8/2007 | Kent et al. | |
| 7,273,992 | B2 | 9/2007 | Kent et al. | |
| 7,281,324 | B2 | 10/2007 | Kent et al. | |
| 7,351,095 | B2 | 4/2008 | Olsen | |
| 7,393,144 | B2 | 7/2008 | Khemakhem et al. | |
| 7,411,127 | B2 | 8/2008 | Viguerie | |
| 7,417,197 | B2 | 8/2008 | Kent et al. | |
| 7,479,019 | B2 | 1/2009 | Kent et al. | |
| 7,507,114 | B2 | 3/2009 | Kent et al. | |
| 7,517,246 | B2 * | 4/2009 | Miyakawa et al. | 439/587 |
| 7,585,181 | B2 | 9/2009 | Olsen | |
| 7,718,927 | B2 | 5/2010 | Kent et al. | |
| 7,727,016 | B2 * | 6/2010 | Lamdiziz et al. | 439/587 |
| 7,901,239 | B2 * | 3/2011 | Weber | 439/455 |
| 2006/0094275 | A1 * | 5/2006 | Fukatsu et al. | 439/275 |
| 2010/0330849 | A1 * | 12/2010 | Wang et al. | 439/701 |
| 2011/0034088 | A1 * | 2/2011 | Mao et al. | 439/701 |

* cited by examiner

*Primary Examiner* — Gary Paumen
(74) *Attorney, Agent, or Firm* — Kilpatrick Townsend & Stockton LLP

(57) ABSTRACT

A device and assembly related to connecting cables, wires, and electrical devices are described herein. The device and assembly can comprise a panel connector removably coupled to a cable connector. The panel connector can include a panel connector retainer, a panel connector subretainer, and at least one contact pin. The cable connector can include a cable connector retainer, a cable connector subretainer, and at least one contact pin. Also described herein are connectors having a ground clamp and cable clamp useful in connecting cables, wires, and electrical devices.

18 Claims, 10 Drawing Sheets

CONNECTOR ASSEMBLY, DEVICE, AND KIT

RELATED APPLICATIONS

The present application claims priority under 35 U.S.C. §119(e) from U.S. Provisional Patent Application No. 61/482,962, filed May 5, 2011, which is incorporated by reference herein in its entirety.

TECHNICAL FIELD OF INVENTION

The present invention relates generally to assemblies and devices related to connecting cables and electrical devices.

BACKGROUND

Connectors can be used to connect cables, electronic devices, and/or other devices for a number of reasons and in a number of industries. Some conventional connectors available to users can be cumbersome and difficult to assemble and use in the field, offering little flexibility in using such conventional connectors. Components of conventional connectors are often fabricated as a single piece or pre-assembled in a manufacturing setting. Such connectors may be acceptable for certain uses; however, such connectors may not be easily interchangeable, repaired, and/or terminated in the field. Often, a connector that has or develops a faulty or non-functioning component is discarded rather than repaired. Often, pre-assembled and pre-soldered connectors may not allow a user to assemble and/or customize the connector to her particular needs.

SUMMARY

Described herein are some embodiments of a device and assembly related to connectors. In some embodiments described herein, a device can comprise a panel connector and a cable connector where the cable connector is removably coupled to a panel connector. In some such embodiments, the panel connector may comprise a panel connector retainer, a panel connector subretainer, and at least one contact pin. The panel connector retainer can be removably coupled to the panel connector subretainer to form a panel connector subassembly. In some such embodiments, the cable connector may comprise a cable connector retainer, a cable connector subretainer, and at least one contact pin. The cable connector retainer can be removably coupled to the cable connector subretainer to form a cable connector subassembly.

In other embodiments, a panel connector device is described herein. In some embodiments, the panel connector device may comprise a retainer, a subretainer, at least one contact pin, and a housing. The retainer can comprise at least one opening. The subretainer can comprise at least one opening that corresponds to the at least one opening of the retainer. In some embodiments, the subretainer is removably coupled to the retainer to form a panel connector subassembly. The at least one contact pin can be positioned within the corresponding openings of the retainer and the subretainer and secured within the panel connector subassembly. The housing can be removably coupled to the panel connector subassembly.

In yet other embodiments, a cable connector device is described herein. In some embodiments, the cable connector device may comprise a retainer, a subretainer, at least one contact pin, and a housing. The retainer can comprise at least one opening. The subretainer can comprise at least one opening that corresponds to the at least one opening of the retainer. In some embodiments, the subretainer is removably coupled to the retainer to form a cable connector subassembly. The at least one contact pin can be positioned within the corresponding openings of the retainer and the subretainer and secured within the cable connector subassembly. The housing can be removably coupled to the cable connector subassembly. In some embodiments, the cable connector device further comprises a ground clamp and a cable clamp.

In yet other embodiments described herein, a cable connector device can comprise a housing, a gasket, a ground clamp, and a cable clamp. In some such embodiments, the housing can include at least one angled wall and a notch. The cable clamp can be coupled to the housing such that at least one angled wall can cause horizontal movement of the cable clamp and the ground clamp upon the coupling. The horizontal movement of the cable clamp and the ground clamp can compress the gasket upon the housing.

These illustrative aspects and embodiments are mentioned not to limit or define the invention, but to provide examples to aid understanding of the inventive concepts disclosed in this application. Other aspects, advantages, and features of embodiments of the present invention will become apparent after review of the entire application.

DETAILED DESCRIPTION

Figure 1A:
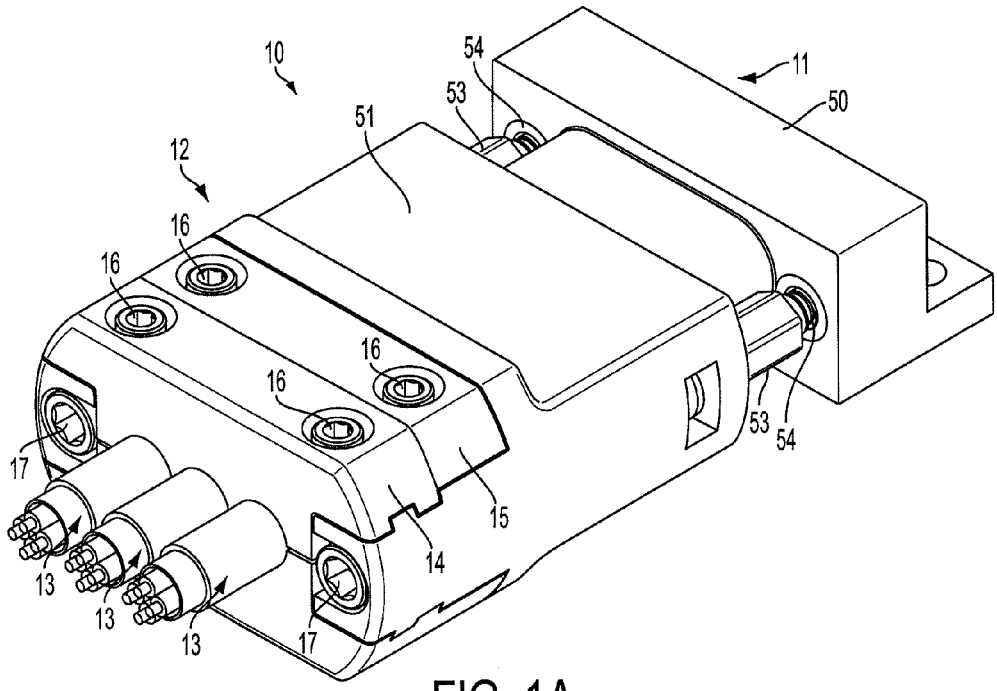
FIG. 1A is a top front perspective view of a connector assembly according to one embodiment of the present invention.

Certain aspects and embodiments of the present invention relate to connector assemblies and devices. Some embodiments can provide a removably secured snap-fit connection that may allow more flexibility and options for a user in the field for assembly, disassembly, terminating contact pins, maintenance, and repair of a connector device or assembly.

In some embodiments described herein, a device can comprise a panel connector and a cable connector where the cable connector is removably coupled to a panel connector. In some such embodiments, the panel connector may comprise a panel connector retainer, a panel connector subretainer, and at least one contact pin. The panel connector retainer can be removably coupled to the panel connector subretainer to form a panel connector subassembly. In some such embodiments, the cable connector may comprise a cable connector retainer, a cable connector subretainer, and at least one contact pin. The cable connector retainer can be removably coupled to the cable connector subretainer to form a cable connector subassembly.

In some embodiments, the at least one contact pin of the panel connector can be secured within the panel connector subassembly. In some embodiments, the at least one contact pin of the cable connector can be secured within the cable connector subassembly.

In some embodiments, the panel connector retainer can be coupled to the panel connector subretainer by at least one latch having a protrusion of the panel connector retainer and at least one stop surface of the panel connector subretainer. In some embodiments, the protrusion abuts the stop surface to create the coupling. In other embodiments, different configurations of mateable connections or fasteners can be used.

In some embodiments, the cable connector can comprise a housing. In some embodiments, the cable connector retainer can include at least one latch comprising a protrusion. In some such embodiments, the protrusion of the cable connector retainer can abut a wall of the housing the couple the cable connector subassembly to the housing.

In some embodiments, the cable connector can comprise a ground clamp and a cable clamp. In some embodiments, the housing of the cable connector can include at least one angled wall. In some embodiments, the housing of the cable connector can include a notch. The cable clamp can be coupled to the housing such that at least one angled wall can cause horizontal movement of the cable clamp and the ground clamp upon the coupling. In some embodiments, the notch can provide a guide structure to aid in accurate positioning of the cable clamp upon the housing.

In some embodiments, the device can comprise a gasket. In some embodiments, the gasket can be compressed between the ground clamp and the housing upon the coupling of the cable clamp to the housing.

In some embodiments, the ground clamp can comprise a ground wire. In some embodiments, a contact pin can be terminated to the ground wire. In some embodiments, the ground wire is molded into the ground clamp.

In some embodiments, the at least one contact pin of the cable connector can comprise at least one latch. In some such embodiments, the at least one latch can abut a first wall of the cable connector retainer to couple the at least one contact pin to the cable connector retainer.

In some embodiments, the panel connector further comprises a housing. In some embodiments, the housing can comprise a material to minimize signal noise transferred through the device during use.

In some embodiments, the panel connector device may comprise a retainer, a subretainer, at least one contact pin, and a housing. The retainer can comprise at least one opening. The subretainer can comprise at least one opening that corresponds to the at least one opening of the retainer. In some embodiments, the subretainer is removably coupled to the retainer to form a panel connector subassembly. The at least one contact pin can be positioned within the corresponding openings of the retainer and the subretainer and secured within the panel connector subassembly. The housing can be removably coupled to the panel connector subassembly.

In some embodiments, a cable connector device may comprise a retainer, a subretainer, at least one contact pin, and a housing. The retainer can comprise at least one opening. The subretainer can comprise at least one opening that corresponds to the at least one opening of the retainer. In some embodiments, the subretainer is removably coupled to the retainer to form a cable connector subassembly. The at least one contact pin can be positioned within the corresponding openings of the retainer and the subretainer and secured within the cable connector subassembly. The housing can be removably coupled to the cable connector subassembly.

In yet other embodiments described herein, a connector assembly can comprise a panel connector and a cable connector where the cable connector is removably coupled to a panel connector. In some such embodiments, the panel connector may comprise a panel connector retainer, a panel connector subretainer, and at least one contact pin. The panel connector retainer is removably coupled to the panel connector subretainer such that the at least one contact pin is secured within the panel connector. In some such embodiments, the cable connector may comprise a housing, a cable connector retainer, a cable connector subretainer, and at least one contact pin such that the at least one contact pin is secured within the cable connector.

In some such embodiments, the at least one contact pin of the cable connector is removably coupled to the at least one contact pin of the panel connector.

In yet other embodiments described herein, a cable connector device can comprise a housing, a gasket, a ground clamp, and a cable clamp. In some such embodiments, the housing can include at least one angled wall and a notch. The cable clamp can be coupled to the housing such that at least one angled wall can cause horizontal movement of the cable clamp and the ground clamp upon the coupling. The horizontal movement of the cable clamp and the ground clamp can compress the gasket upon the housing.

The following sections describe various additional embodiments and examples with reference to the drawings in which like numerals indicate like elements and directional description are used to describe illustrative embodiments but, like the illustrative embodiments, should not be used to limit the present invention.

FIG. 1A shows a connector assembly 10 having a panel connector 11 attached to a cable connector 12. The panel connector 11 can be positioned within, on, or adjacent to a panel or a control box (not shown) that is operably connected to a computer, server, or other electrical device to which a user desires to transfer information or signals. The panel connector 11 comprises a housing 50. Within the housing 50, a panel connector subassembly can be positioned and housed (as further described in connection with later Figures). In some embodiments, the housing 50 can minimize or suppress signal noise transferred through the connector assembly. In some embodiments, the housing 50 of the panel connector 11 can be comprised of a plastic-based composite material or resin. For example, the housing 50 can comprise a material including an EMI/RFD/ESD attenuation compound. In other embodiments, the housing can comprise metal based plating, metal injection molded material, or other materials known to one of ordinary skill in the art to suppress signal noise.

The cable connector 12 comprises a housing 51. Within the housing 51, a cable connector subassembly can be positioned and housed (as further described in connection with later Figures). The cable connector 12 is fastened to the panel connector 11 by screws 17 that span a substantial portion of the length of the connector assembly 10. The screws 17 pass through a longitudinal channel within the housing 51 and to a receiving hole 54 in the housing 50. A fastening nut 53 is positioned about the screw 17 at the end in proximity to the panel connector 11. The screw 17 or the fastening nut 53 about the screw 17 can be rotated or adjusted in order to tighten or secure the cable connector 12 to the panel connector 11.

Cables 13 are shown being attached to the cable connector 12. Cables 13, in the embodiment shown, comprise an insulation layer, a braided layer, and a plurality of wires. The cables 13 can be secured to the cable connector using a ground clamp 15 and a cable clamp 14. The ground clamp 15 and the cable clamp 14 can be tightened or secured upon the cables 13 and housing 51 via screws 16.

Figure 1B:
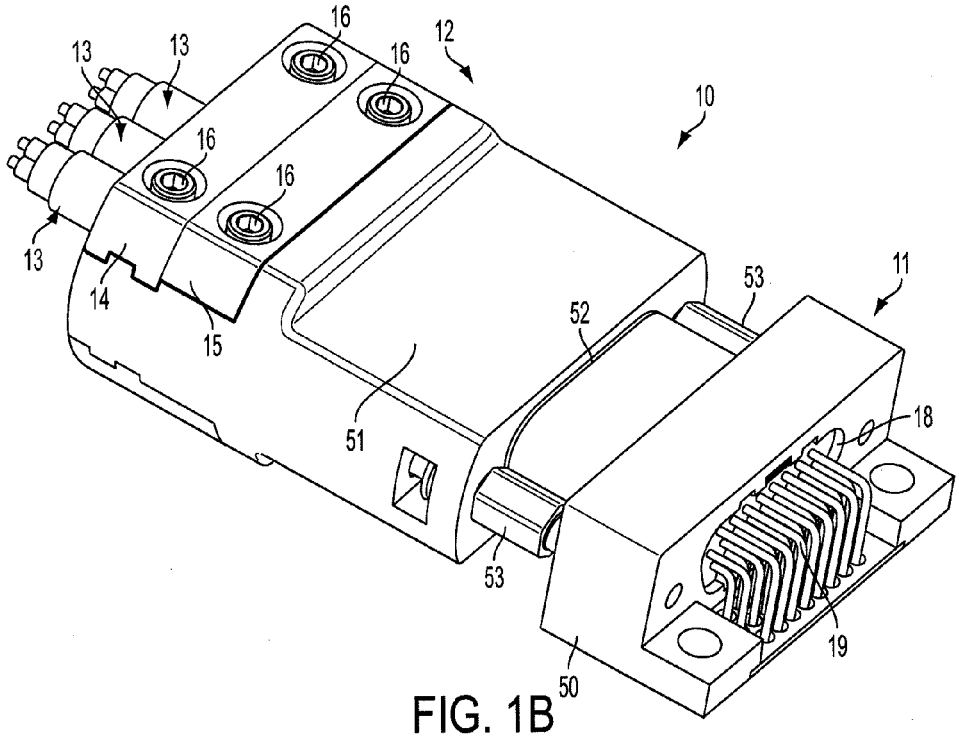
FIG. 1B is a top rear perspective view of a connector assembly according to one embodiment of the present invention.

FIG. 1B shows a rear perspective view of the connector assembly 10 shown in FIG. 1A. In addition to the features described in connection with FIG. 1A above, an O-ring 52 is shown. The O-ring 52 is positioned between the panel connector 11 and cable connector 12. As the screw(s) 17 (not shown in FIG. 1B) are rotated and tightened, the O-ring 52 can be compressed between the panel connector 11 and the cable connector 12. Upon sufficient tightening of screws 17, the O-ring 52 can provide a seal between the panel connector 11 and the cable connector 12 to eliminate or minimize ingress or penetration of moisture into the connector assembly.

FIG. 1B further shows a plurality of contact pins 19 extending from a panel connector subretainer 18. In the embodiment shown in FIG. 1B, the plurality of contact pins 19 have been formed to include a bend at a substantially right angle. Although not shown, the panel connector 11 can be positioned upon a circuit board or other like device in some embodiments. In some such embodiments, the plurality of contact pins 19 can be operably connected to a plurality of circuits in order to transmit or transfer the desired signals or information. In other embodiments, the contact pins 19 can be generally straight or formed having an angle other than a right angle. The plurality of contact pins 19 can protrude from the panel connector subretainer 18 at a plurality of angles.

Figure 2:
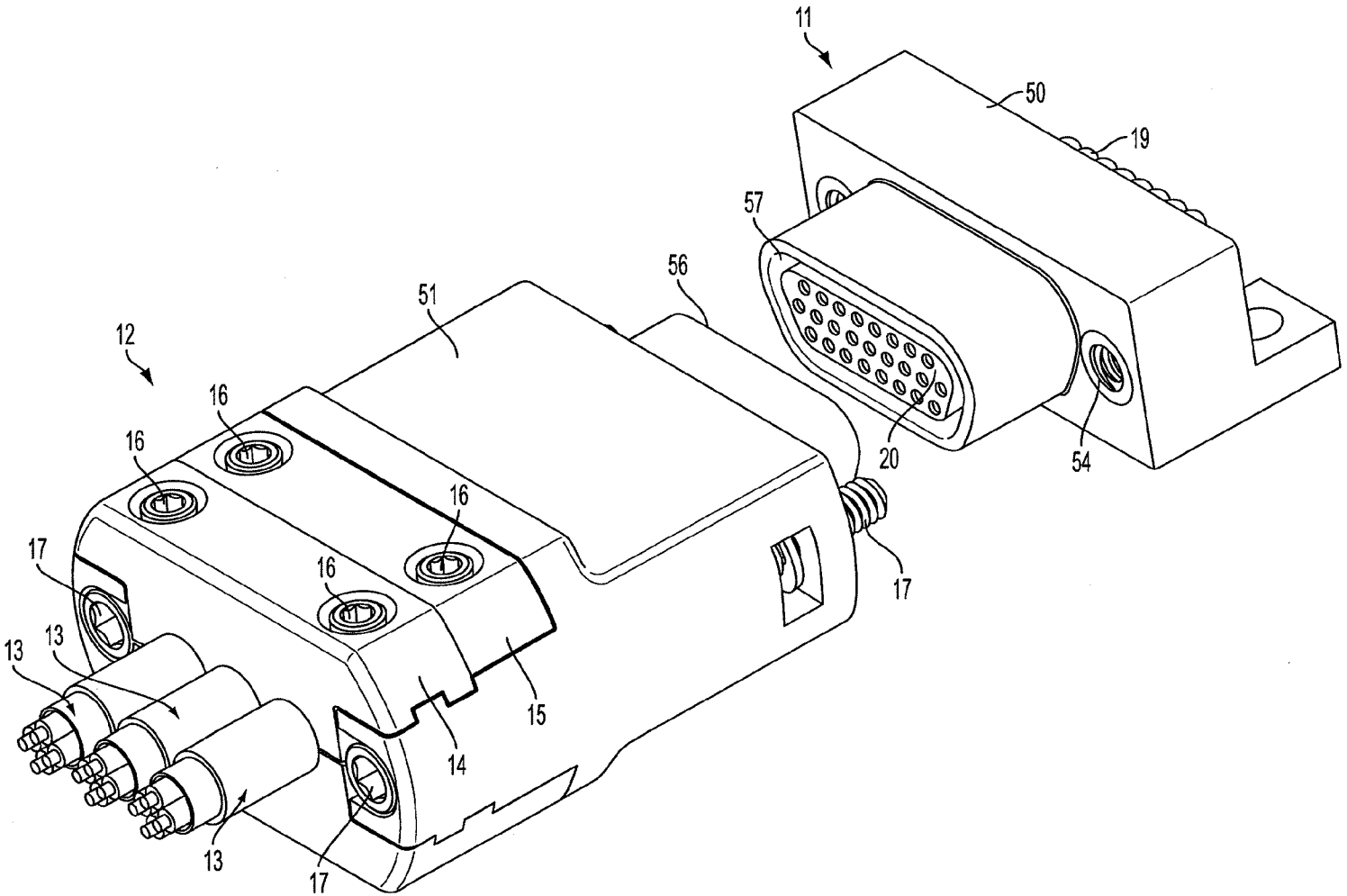
FIG. 2 is an exploded top perspective view of a connector assembly according to one embodiment of the present invention.

FIG. 2 shows an exploded perspective view of the connector assembly 10. The cable connector 12 can be coupled to the panel connector 11. A panel connector retainer 20 is shown within the housing 50 of the panel connector 11. An opening 57 is defined between the outer boundary of the panel connector retainer 20 and the housing 50. The housing 51 comprises a first end 56 having a complimentary, mateable dimension and configuration to that of the housing 50, such that the first end 56 can be inserted into the opening 57 of the panel connector 11. In the embodiment shown in FIG. 2, the panel connector 11 includes the receiving ports or "female" end of the connection, and the cable connector 12 includes protruding pins or "male" end of the connection at the first end 56. In other embodiments, the panel connector 11 may include the protruding pins or "male" end of the connection, and the first end 56 of the housing 51 can comprise receiving ports or "female" end of the connection.

Figure 3A:
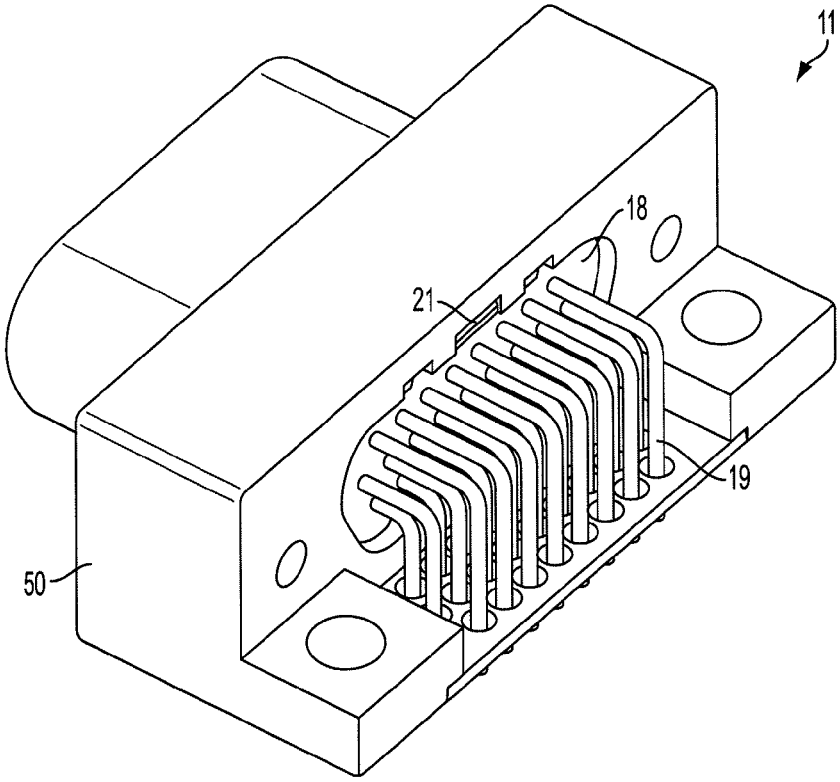
FIG. 3A is a rear perspective view of a panel connector device according to one embodiment of the present invention.
Figure 3B:
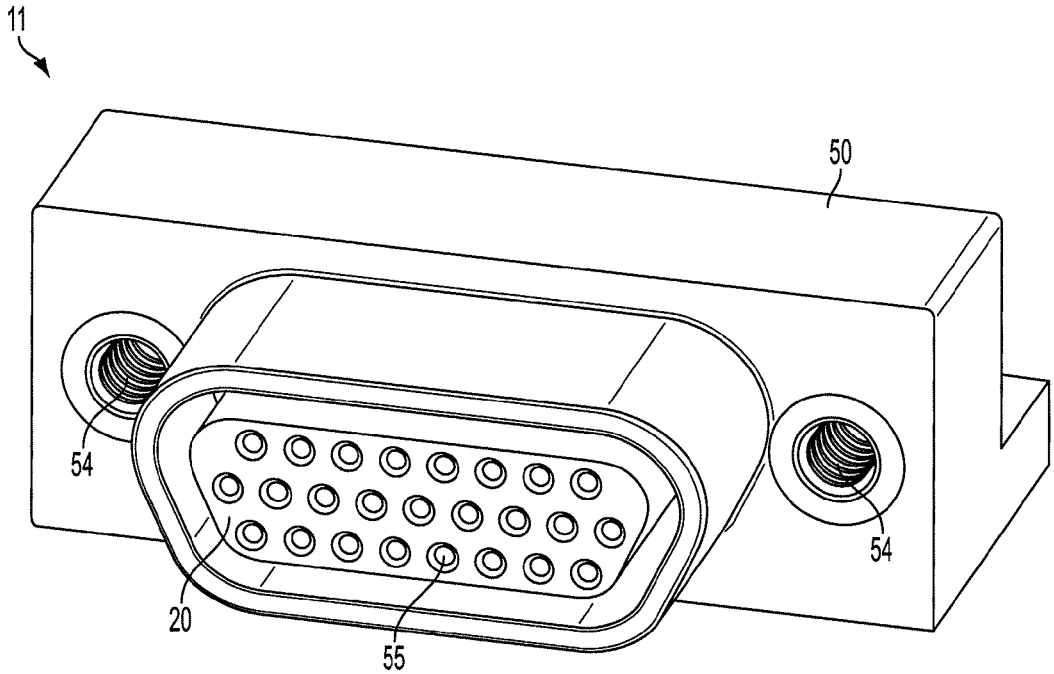
FIG. 3B is a front perspective view of a panel connector device according to one embodiment of the present invention.

FIGS. 3A and 3B show perspective views of the panel connector 11. The panel connector 11 includes the housing 50 having receiving holes 54 (shown in FIG. 3B) into which screws 17 can be positioned, tightened, or secured. The plurality of contact pins 19 are shown extending from the rear surface of subretainer 18. In FIG. 3B, the front surface of the retainer 20 is shown having a plurality of ports 55. The ports 55 correspond to the plurality of contact pins 19. The number, configuration, and size of the ports and corresponding contact pins can vary according to preferences of a user without departing from the principles and spirit of the present disclosure. FIG. 3A further shows an attachment device 21 that secures the subretainer 18 (and the panel connector subassembly) into the housing 50, which is described further in connection with FIG. 4-6B.

Figure 4:
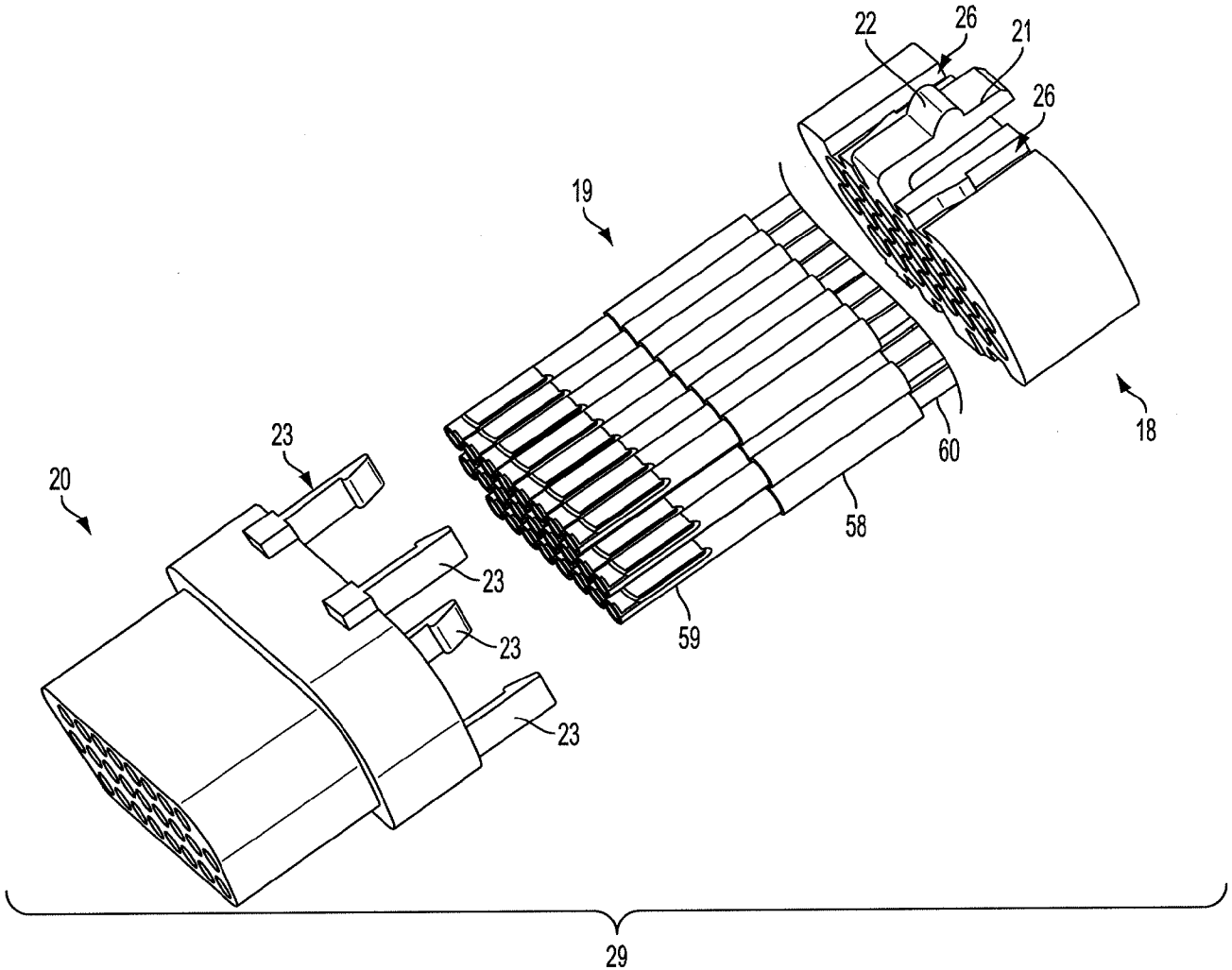
FIG. 4 is an exploded perspective view of a panel connector sub-assembly according to one embodiment of the present invention.

FIG. 4 shows an exploded perspective view of a panel connector subassembly 29. The panel connector subassembly 29 is positioned within the housing 50. The panel connector subassembly 29 comprises the subretainer 18, the plurality of contact pins 19, and the retainer 20. Upon the joining of the subretainer 18 and retainer 20, the panel connector subassembly 29 is formed.

Figure 5:
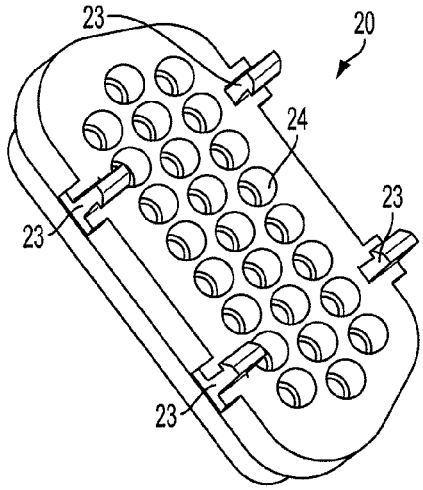
FIG. 5 is a perspective view of a panel connector retainer according to one embodiment of the present invention.
Figure 6A:
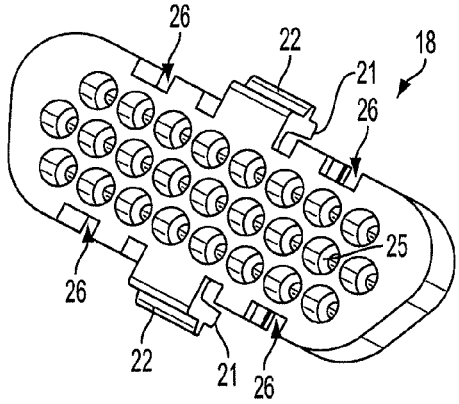
FIG. 6A is a front perspective view of a panel connector subretainer according to one embodiment of the present invention.
Figure 6B:
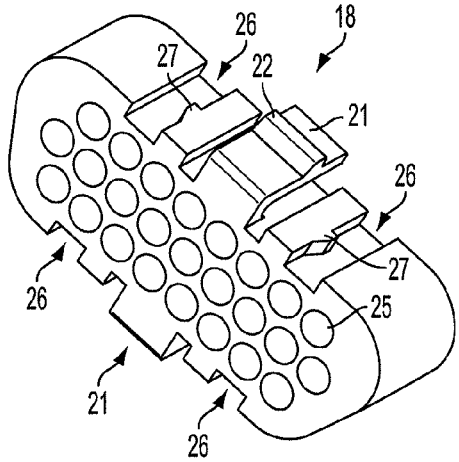
FIG. 6B is a top, front perspective view of a panel connector subretainer according to one embodiment of the present invention.

As shown in FIGS. 4, 6A, and 6B, the subretainer 18 comprises channels 26 on one surface. The channels 26 further include stop surfaces 27 (shown in FIG. 6B). As shown in FIGS. 4 and 5, the retainer 20 comprises latches 23 each having a protruding tab or hook-like structure. The channels 26 of the subretainer 18 can receive the latches 23 to couple the retainer 20 to the sub-retainer 18. The subretainer 18 further includes an attachment device 21 in the embodiment shown. The attachment device 21 comprises a tab 22 to aid in the positioning and securing of the panel connector subassembly 29 to the housing 50.

The subretainer 18 further comprises a plurality of bore holes 25. Each bore hole 25 is counter-bored to include a plurality of regions having a different diameter (as shown in FIG. 6A). In some embodiments, counter-boring the bore holes can provide a stop surface or shelf to provide a structure to prevent a contact pin from passing entirely through the bore hole 25. For example, in the embodiment shown in FIG. 6A, a region of a bore hole 25 having a smaller diameter than another region can prevent a contact pin from passing entirely through the bore hole 25.

As shown in FIGS. 4 and 5, the retainer 20 similarly includes a plurality of bore holes 24. Each bore hole 24 is counter-bored to include a plurality of regions having a different diameter (as shown in FIG. 5). In some embodiments, the effect of counter-boring the bore holes is that a stop surface or shelf can be formed to provide a structure to prevent a contact pin from passing entirely through the bore hole 24. For example, in the embodiment shown in FIG. 5, a region of a bore hole 24 having a smaller diameter than another region can prevent a contact pin from passing entirely through the bore hole 24.

As shown in the embodiment of FIG. 4, each contact pin 19 has a middle section 58. The middle section 58 has a larger diameter than a first end section 59 or a second end section 60 of each contact pin 19. As further described and shown in connection with FIGS. 5-6B, bore holes included in the retainer 20 and the subretainer 18 can include sections with different diameters to aid in the positioning and securing of the plurality of contact pins 19.

Referring to FIG. 4, the panel connector subassembly 29 can be assembled by inserting the plurality of contact pins 19 into the bore holes 25 of the subretainer 18. The second end of the contact pins 19 extend through the bore holes 25 (shown in FIG. 6A). The middle section 58 of the contact pins 19 abut the structure in the bore holes 25 where the diameter of the bore holes 25 decreases. The retainer 20 can then be attached to the plurality of contact pins 19 at the end in proximity to the first end section 59 of the contact pins 19. The bore holes 24 (shown in FIG. 5) of the retainer 20 include a surface (where the diameter of the bore holes 24 decreases) to abut the middle section 58 of the contact pins 19. The retainer 20 is then secured to the subretainer 18 via the latches 23 each having a protruding tab or hook like structure. The protruding tab or hook like structure of the latch 23 slides past the stop surface 27 in the channel 26 to create a removably secured connection.

Figure 7:
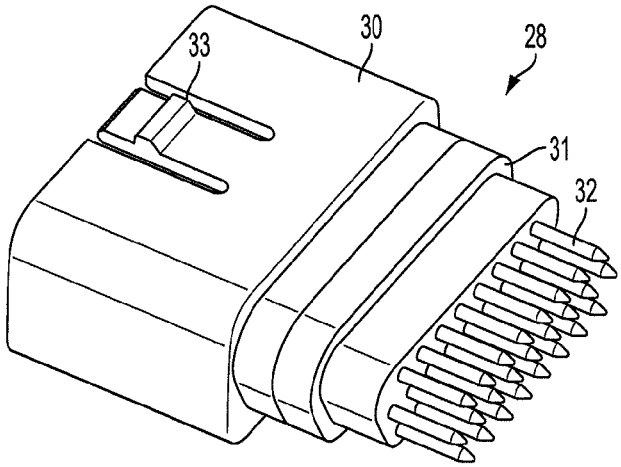
FIG. 7 is a perspective view of a cable connector subassembly according to one embodiment of the present invention.

Referring now to FIG. 7, a cable connector subassembly 28 is shown. The cable connector subassembly 28 includes a cable connector retainer 30 connected to a cable connector subretainer 31. A plurality of contact pins 32 extend through the cable connector subretainer 31. The retainer 30 includes an attachment device 33 comprising a tab structure. The attachment device 33 can secure the cable connector subassembly 28 to the housing 51 (not shown in FIG. 7).

Figure 8:
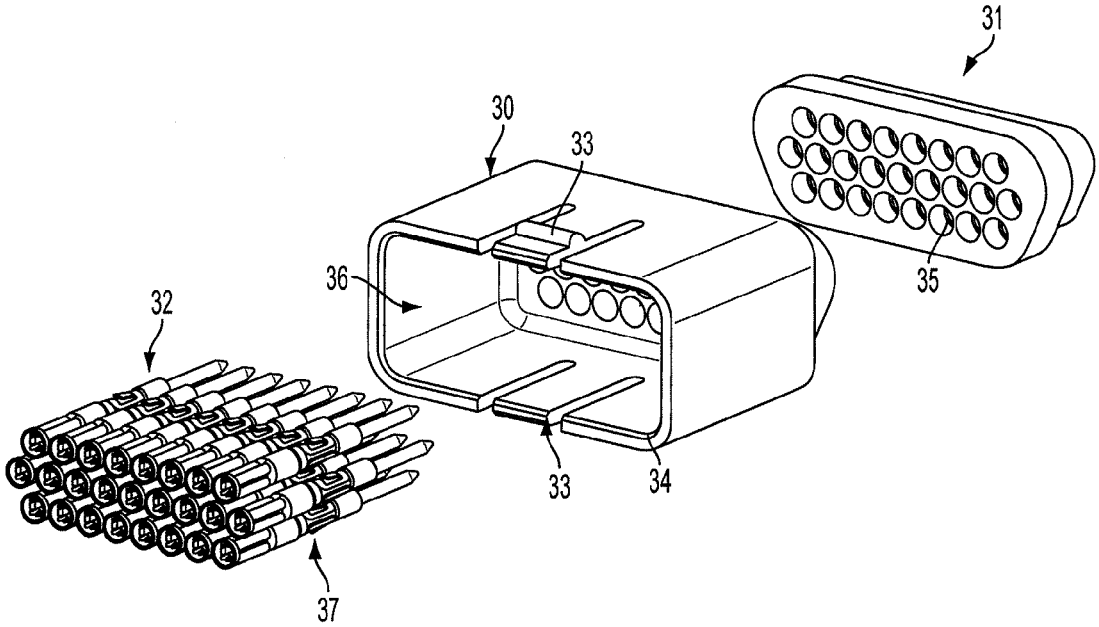
FIG. 8 is an exploded perspective view of a cable connector subassembly according to one embodiment of the present invention.

FIG. 8 shows an exploded view of the cable connector assembly 28 shown in FIG. 7. The plurality of contact pins 32 are directed into a cavity 36 defined by the wall structure of the retainer 30. Each contact pin 32 includes a clip device 37 comprising opposing latches, which are further described in connection with FIG. 9. Each contact pin 32 is inserted into a corresponding bore hole 34 within the retainer 30. Each contact pin extends through the retainer 30 and the subretainer 31, also having a corresponding bore hole 35.

Figure 9:
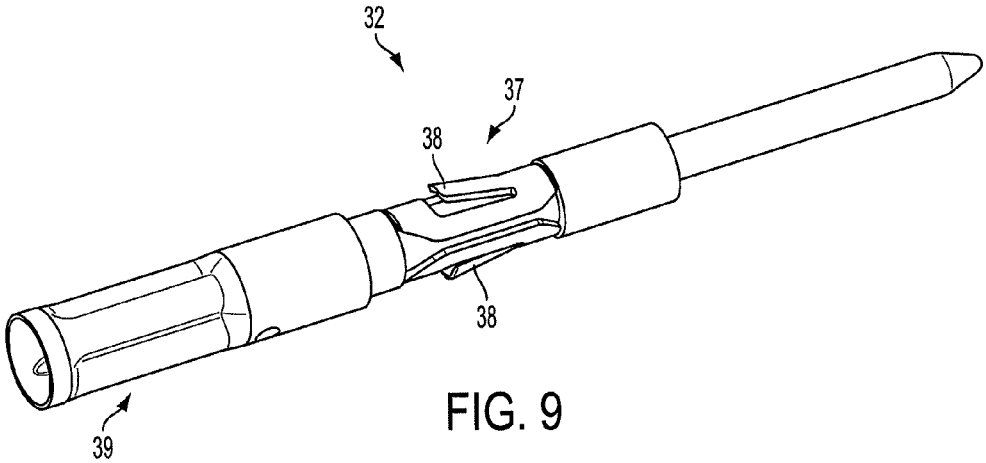
FIG. 9 is a perspective view of a contact pin according to one embodiment of the present invention.

FIG. 9 shows one embodiment of a contact pin 32 comprising a clip device comprising opposing latches 38. In the embodiment shown in FIG. 9, a contact pin 32 includes a crimped end 39. In some embodiments, the contact pin 32 can be first inserted into the retainer 30 in a non-crimped configuration. The contact pin 32 can be crimped upon a wire (not shown) in the field after the contact pin 32 has been seated in the cable connector subassembly. The crimping of the contact pin 32 can be conducted by a tool or vice-like device applying force inwardly in the radial direction.

Figure 10:
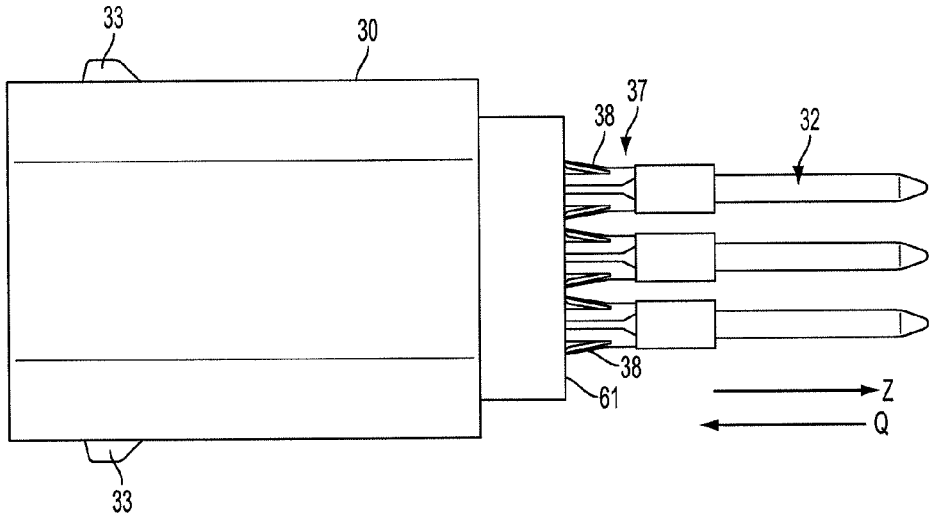
FIG. 10 is a side elevation view of a cable connector retainer and plurality of contact pins according to one embodiment of the present invention.

FIG. 10 shows a side elevation view of the plurality of contact pins 32 extending through a retainer 30. Each contact pin 32 is positioned within the cable connector retainer 30 such that the opposing latches 38 of the clip device 37 clears the outer wall 61 of the cable connector retainer 30. The opposing latches are comprised of a material having sufficient flexibility and rigidity in order to alter a dimension or configuration without fracturing. The opposing latches 38 are configured such that upon motion in a Z direction shown in FIG. 10, the opposing latches 38 can pass through the bore hole 34 of the retainer 30. However, upon the application of force in a Q direction shown in FIG. 10, the opposing latches 38 prevent the contact pin 32 from being removed through the bore hole 34 without a force applied in an inwardly radial direction of the contact pin 32 in conjunction with a force in the Q direction. The radial direction force would cause the opposing latches 32 to compress into a more cylindrical shape in order for the contact pin 32 to pass through the bore hole 34.

Figure 11A:
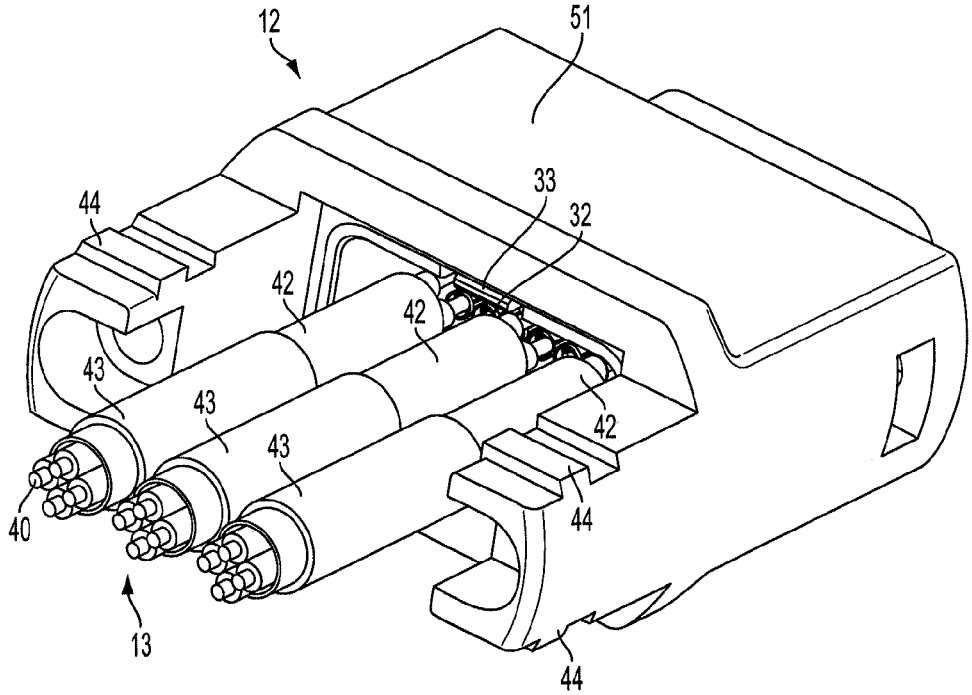
FIG. 11A is a top perspective view of a cable connector device and a plurality of cables according to one embodiment of the present invention.

FIG. 11A shows the cable connector 12 having the cable connector subassembly positioned within the housing 51. The attachment device 33 comprising a tab on the cable connector retainer 30 is snapped into the housing 51 to create a removably secure connection locking the retainer 30 (and entire cable connector subassembly) into place. The cables 13 are connected to the plurality of contact pins 32 via a plurality of wires 40. In the embodiment shown, each cable 13 has a plurality of wires 40, a braided layer 42, and insulation layer 43. Each cable 13 can be stripped to expose the plurality of wires 40 for connection with the plurality of contact pins 32. Each cable 13 can be further stripped of the insulation layer 43 to expose a portion of the braided layer 42. The braided layer 42 can comprise a sufficiently conductive material or resin to facilitate the grounding of the electrical components within the assembly.

Figure 11B:
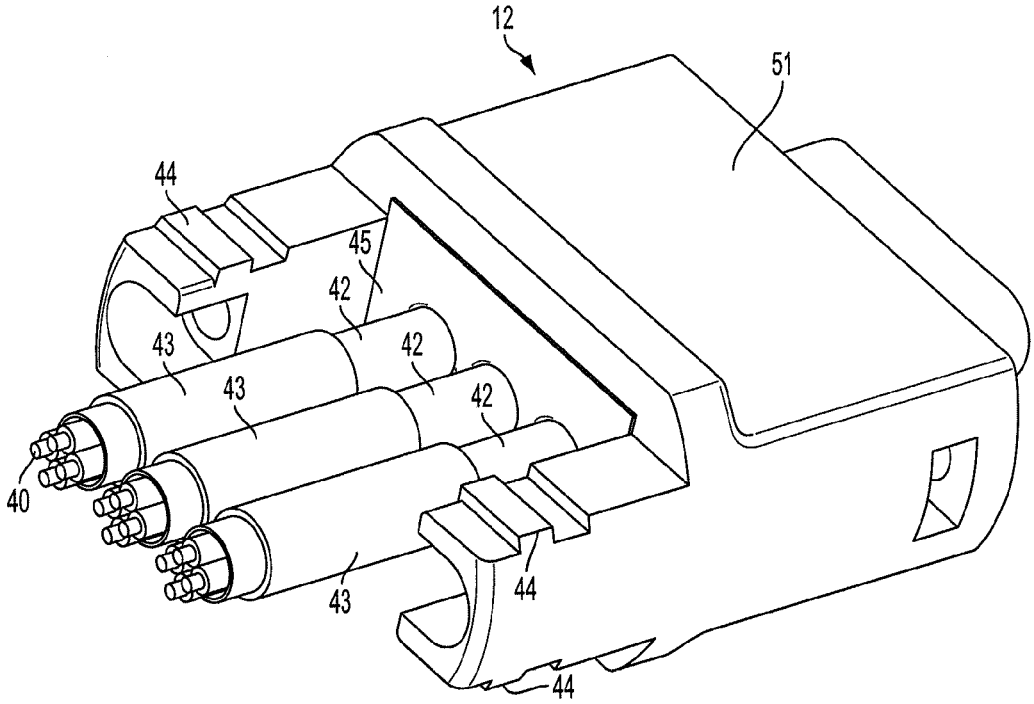
FIG. 11B is a top perspective view of a cable connector device, plurality of cables, and gasket according to one embodiment of the present invention.

The housing 51 further includes a notch 44 to aid in the positioning of the cable clamp 14. In addition to the features described in connection with FIG. 11A above, FIG. 11B shows the cable connector 12 having a gasket 45. The gasket 45 is comprised of a compressible material that can provide a seal to prevent or minimize any undesired ingress of moisture or other material.

Figure 12:
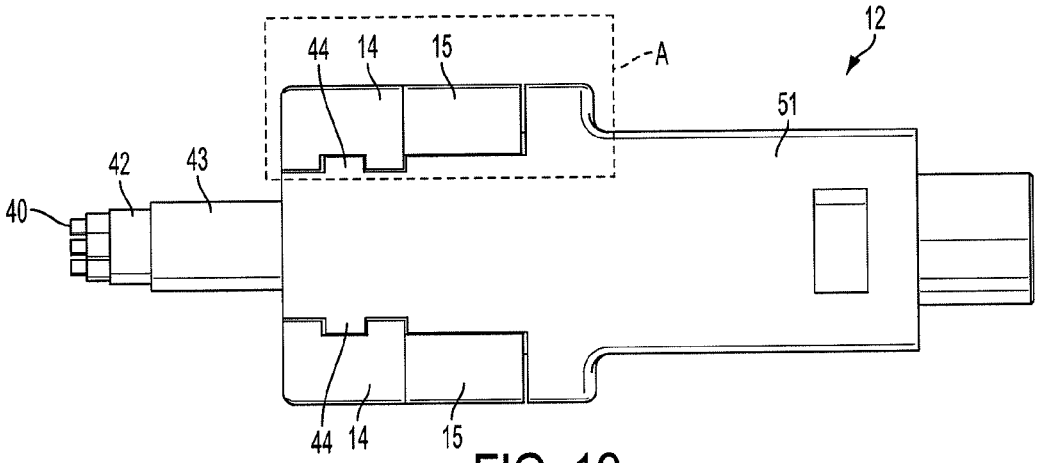
FIG. 12 is a side elevation view of a cable connector device, a ground clamp, and a cable clamp according to one embodiment of the present invention.

FIG. 12 shows a side elevation view of the cable connector 12 having a ground clamp 15 and a cable clamp 14 positioned on the housing 51. The ground clamp 15 is tightened upon the braided layer 42 to ground the electrical components of the assembly. The ground clamp 15 additionally provides a surface that compresses the gasket 45 (as further described below). The cable clamp 14 is tightened upon the insulation layer 43 to prevent unintended movement of the cables 13. The cable clamp 14 additionally functions to aid in the sealing of the cable connector assembly by the gasket 45. The cable clamp 14 has a complementary profile to the housing 51 and notch 44 such that the cable clamp 14 can be properly aligned with the housing 51 and the plurality of cables 13. The ground clamp 15 is positioned upon the exposed braided layer 42 of the cable. The ground clamp 15 and braided layer 42 can be comprised of a sufficiently conductive material or resin to facilitate the grounding of the electrical components of the assembly. The cable clamp 14 is positioned on the insulation layer of the cable in the embodiment shown.

Figure 13A:
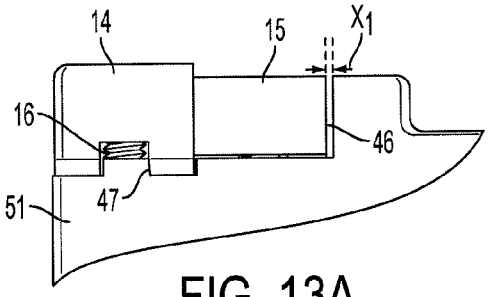
FIG. 13A is an enlarged side view of section A shown in FIG. 12 in a first position.
Figure 13B:
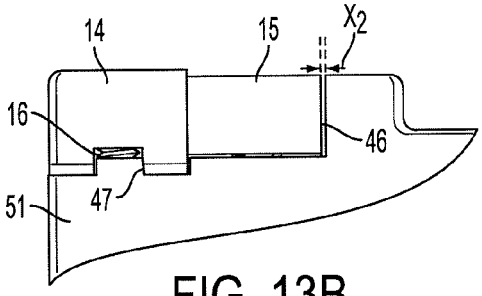
FIG. 13B is an enlarged side view of section A shown in FIG. 12 in a second position.
Figure 13C:
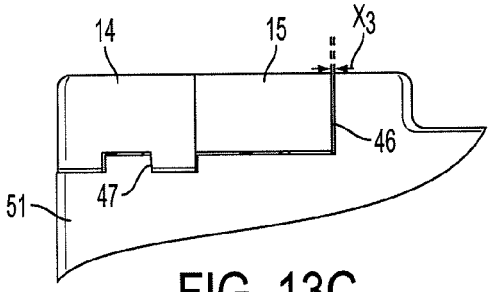
FIG. 13C is an enlarged side view of section A shown in FIG. 12 in a third position.

FIGS. 13A-C show an enlarged view of Section A of FIG. 12. FIGS. 13A-C show the process in which the cable clamp 14 and the ground clamp 15 are secured upon the cables to provide a secure connection. FIG. 13A shows the cable clamp 14 in a first position. The screw 16 has not been fully tightened to affix the cable clamp 14 to the housing 51 in FIG. 13A. The housing 51 comprises a angled surface 47 to facilitate the securing of the clamps to the housing. A space 46 between the ground clamp 15 and housing 51 is present. In FIG. 13A, the space 46 has a distance of $x_1$.

FIG. 13B shows the cable clamp 14 in a second position. The cable clamp 14 has been tightened to move the cable clamp in a generally vertical direction. As the cable clamp 14 is tightened upon the housing 51, the angled surface 47 directs the cable clamp 14 to move in a horizontal direction, and in turn, moves the ground clamp 15 in a horizontal direction. In FIG. 13B, the space 46 has a width of $x_2$. For purposes of comparison, $x_1$ (of FIG. 13A) is greater than $x_2$ (of FIG. 13B).

FIG. 13C shows the cable clamp 14 in a third position. The cable clamp has been tightened to further move the cable clamp in a generally vertical direction. The angled surface 47 further continues to direct the cable clamp 14 to move in a horizontal direction, and in turn, moves the ground clamp 15 further in the horizontal direction. In FIG. 13C, the space 46 has a width of $x_3$. For purposes of comparison, $x_1$ (of FIG. 13A) is greater than $x_2$ (of FIG. 13B), and $x_2$ (of FIG. 13B) is greater than $x_3$ (of FIG. 13C).

As the ground clamp 15 moves in the horizontal direction toward the housing 51 shown in FIG. 13C, the gasket 45 (shown in FIG. 11B) is compressed upon the housing 51 in a wedge effect to create a sufficiently sealed opening to prevent any undesired ingress of moisture or other material.

Figure 14:
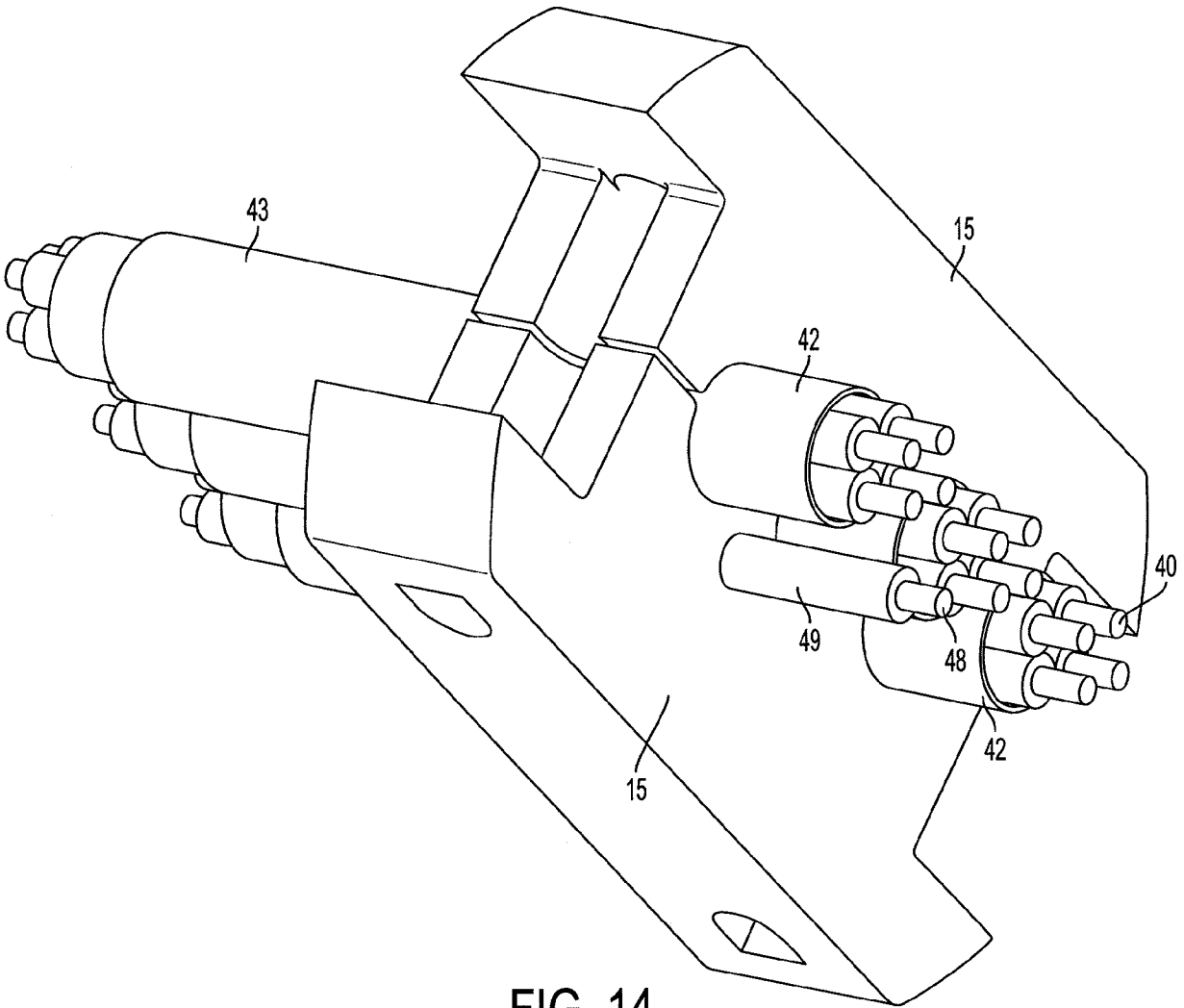
FIG. 14 is a bottom perspective view of a ground clamp and a plurality of wires according to one embodiment of the present invention.

FIG. 14 shows a ground clamp 15 comprising a ground wire 48 insert molded into the ground clamp 15. The ground wire insulation layer 49 surrounds the ground wire 48. The ground clamp 15 can comprise a sufficiently conductive material or resin, for example an EMI/RFD/ESD attenuation compound, to aid in the grounding of the electrical components of the connector assembly. The ground wire 48 can be affixed to a contact pin 32 (not shown) in a similar fashion as the connecting of wires 40.

Connector assemblies of the present invention can be provided in a kit for a user to assemble the device in the field. Some embodiments of the present invention can provide a user a connector that avoids the need of having to solder wires to terminals in the field. The removably secured snap fit connection of the components described herein can create a removably secure connection, which allows a user to assemble the connector easily, and also disassemble the connector to perform simple maintenance or repair, without discarding the entire connector. Some embodiments of the connector assembly described herein can provide a mechanism for creating sufficiently sealed connections, rated at an appropriate ingress rating. Other embodiments can provide components to properly ground the electrical system by integrating the grounding system into the structural components of the assembly. In some embodiments, the connector assembly can comprise a dimension of about 43 millimeters long, 23 millimeters wide, and 13 millimeters thick, while providing a complex, flexible connector.

The foregoing description of the embodiments, including illustrated embodiments, of the devices and assemblies have been presented for the purpose of illustration and description and is not intended to be exhaustive or to limit the invention to the precise forms disclosed. Numerous modifications, adaptations, and uses thereof will be apparent to those skilled in the art without departing from the scope of this description herein.

What is claimed:

1. A device comprising:

a panel connector comprising a panel connector retainer, a panel connector subretainer, and at least one contact pin, wherein the panel connector retainer is removably coupled to the panel connector subretainer to form a panel connector subassembly; and a cable connector comprising a cable connector retainer, a cable connector subretainer, and at least one contact pin, wherein the cable connector retainer is removably coupled to the cable connector subretainer to form a cable connector subassembly, wherein the cable connector is removably coupled to the panel connector.

2. The device of claim 1, wherein the at least one contact pin is secured within the panel connector subassembly.

3. The device of claim 1, wherein the at least one contact pin is secured within the cable connector subassembly.

4. The device of claim 1, wherein the panel connector retainer comprises at least one latch having a protrusion and the panel connector subretainer comprises at least one stop surface, such that the protrusion abuts the stop surface to couple the panel connector retainer to the panel connector subretainer.

5. The device of claim 1, wherein the cable connector further comprises a housing.

6. The device of claim 5, wherein the cable connector retainer comprises at least one latch comprising a protrusion such that the protrusion abuts a wall of the housing to couple the cable connector subassembly to the housing.

7. The device of claim 5, wherein the cable connector further comprises a ground clamp and a cable clamp.

8. The device of claim 7, wherein the housing comprises at least one angled wall to which the cable clamp is coupled.

9. The device of claim 8, further comprising a compressed gasket positioned between the ground clamp and the housing.

10. The device of claim 7, wherein the ground clamp comprises a ground wire.

11. The device of claim 10, wherein the ground wire is molded into the ground clamp.

12. The device of claim 1, wherein the at least one contact pin of the cable connector comprises at least one latch.

13. The device of claim 12, wherein the at least one latch abuts a first wall of the cable connector retainer to couple the at least one contact pin to the cable connector retainer.

14. The device of claim 1, wherein the at least one contact pin of the cable connector can be terminated to a wire by a mechanical action.

15. The device of claim 1, wherein the panel connector further comprises a housing.

16. The device of claim 15, wherein the housing comprises a material to minimize signal noise transferred through the device.

17. A cable connector device comprising:

a retainer comprising at least one opening;

a subretainer comprising at least one opening corresponding to the at least one opening of the retainer, the subretainer being removably coupled to the retainer to form a cable connector subassembly;

at least one contact pin positioned within the at least one opening of the retainer and the at least one opening of the subretainer and secured within the cable connector subassembly;

a housing removably coupled to the cable connector subassembly;

a ground clamp; and a cable clamp.

18. A cable connector device comprising:

a housing having at least one angled wall and a notch;

a gasket comprising a compressible material;

a ground clamp; and a cable clamp, wherein the cable clamp is coupled to the housing such that upon such coupling the at least one angled wall causes horizontal movement of the cable clamp and the ground clamp, compressing the gasket.

* * * * *